US008870896B2

(12) United States Patent
Grieshaber et al.

(10) Patent No.: US 8,870,896 B2
(45) Date of Patent: Oct. 28, 2014

(54) HYBRID EPILATOR DEVICE

(75) Inventors: Frieder Grieshaber, Neu-Anspach (DE); Bernhard Kraus, Braunfels (DE)

(73) Assignee: Braun GmbH

( * ) Notice: Subject to any disclaimer, the term of this patent is extended or adjusted under 35 U.S.C. 154(b) by 166 days.

(21) Appl. No.: 13/282,231

(22) Filed: Oct. 26, 2011

(65) Prior Publication Data

US 2012/0041452 A1 Feb. 16, 2012

(30) Foreign Application Priority Data

Apr. 27, 2009 (EP) ..... 09005818

(51) Int. Cl.
*A61B 17/50* (2006.01)
*A45D 26/00* (2006.01)

(52) U.S. Cl.
CPC ..... *A45D 26/0061* (2013.01); *A45D 26/0028* (2013.01)
USPC ..... 606/133; 606/131

(58) Field of Classification Search
USPC ..... 606/133, 131; 30/34.1, 34.2, 45
See application file for complete search history.

(56) References Cited

U.S. PATENT DOCUMENTS 5,507,753 A * 4/1996 Iwasaki et al. ..... 606/133
5,980,452 A * 11/1999 Garenfeld et al. ..... 600/133
6,740,097 B1 5/2004 Sanchez-Martinez
2007/0227175 A1 10/2007 Samonigg et al.
2008/0045975 A1 2/2008 Sanchez-Martinez
2008/0269780 A1 10/2008 Sanchez-Martinez et al.
2010/0234858 A1 9/2010 Sanchez-Martinez et al.

FOREIGN PATENT DOCUMENTS

JP 56-100088 A 8/1981
JP 04-269993 A 9/1992
JP 09-103319 A 4/1997
JP 2000-060629 A 2/2000

OTHER PUBLICATIONS

International Search Report mailed date Jul. 27, 2010, 3 pages.

* cited by examiner

*Primary Examiner* — Tuan V Nguyen
*Assistant Examiner* — Tin Nguyen
(74) *Attorney, Agent, or Firm* — Jay A. Krebs; David K. Mattheis; Brent M. Peebles

(57) ABSTRACT

The present invention discloses a hybrid epilator device that comprises a razor blade having a sharp edge for cutting hairs, an epilation cylinder comprising at least a pair of clamping elements that during operation are actuated by an actuation system between an open position and a closed position so that hairs can feed into the gap between the pair of clamping elements in the open position and are gripped and plucked out from the skin surface when the pair of clamping elements is in the closed position, and a manually operable adjustment mechanism that has a least a first adjustment and a second adjustment such that in the first adjustment and the second adjustment the skin surface can be simultaneously contacted by the sharp edge of the razor blade and an circumferential area of the epilation cylinder. This allows switching between two different epilation efficiencies of the epilation cylinder.

9 Claims, 4 Drawing Sheets

HYBRID EPILATOR DEVICE

FIELD OF THE INVENTION

The present invention is concerned with a hybrid epilator device and in particular with a hybrid epilator device that comprises a razor blade.

BACKGROUND OF THE INVENTION

A hybrid epilator device comprising a razor blade was first described in German patent application No. 102007050661.0-23.

SUMMARY OF THE INVENTION

It is now desirable to provide an improved hybrid epilator device that allows for more convenient usage. Such a hybrid epilator device is disclosed in the present invention.

The hybrid epilator device as proposed comprises at least a razor blade that has a sharp edge for shaving off hairs growing on a skin surface and an epilation cylinder intended for driven rotation around its cylinder axis that comprises at least a pair of clamping elements that are arranged to be actuated by an actuation system during operation between an open position in which a gap is present between the clamping elements so that hairs can feed into the gap and a closed position in which the clamping elements are in tight contact so that hairs that were present in the gap are firmly gripped and plucked out of the skin surface when the epilation cylinder rotates. The razor blade is arranged behind the epilation cylinder with respect to a use direction that is defined by the sharp edge of the razor blade. A circumferential part of the epilation cylinder and the sharp edge of the razor blade define a skin contact surface along which the hybrid epilator device is to be drawn over the skin surface to effectuate successive plucking out of hairs and shaving off of hairs that still remain on the epilated skin surface. In use, the skin contact surface defined by the device coincides with the skin surface. Obviously, the closed position of the pair of clamping elements will be assumed with a certain angle with respect to the skin contact surface (or the skin surface). The hybrid epilator device further comprises a manually operable adjustment mechanism that has at least a first adjustment and a second adjustment such that the sharp edge of the razor blade and the circumferential part of the epilation cylinder can simultaneously contact the skin surface during operation in the first adjustment and in the second adjustment, but the angular position at which the closed position of the clamping elements is assumed with respect to the skin contact surface (or: skin surface during operation) is different in the first adjustment and in the second adjustment.

The epilation efficiency (the epilation efficiency being defined as the number of hairs being plucked out from a skin surface area in a single stroke vs. the number of hairs growing on the skin surface area before epilation treatment) of the epilation cylinder depends on the angle at which the closed position is assumed. Hence, the proposed hybrid epilator device allows for adjusting the epilation efficiency by the manually operable adjustment mechanism and hence the ratio between plucked out hairs vs. shaved off hairs. The latter hair removal process being essentially pain free, so that the proposed hybrid epilator device allows for complete hair removal in a single stroke (it can be assumed that the razor blade will shave off all hairs that remain on the skin surface after epilation) with an adjustable epilation ratio (in other words: an adjustable pain level).

In an embodiment, the manually operable adjustment mechanism comprises a mounting structure at which the razor blade is mounted, which mounting structure is movable at least between a first position and a second position, where the manually operable adjustment mechanism is in its first adjustment when the mounting structure is in the first position and its second adjustment when the mounting structure is in its second position. By moving the mounting structure that carries the razor blade relative to the epilation cylinder, the angular position at which the closed position of the clamping elements is assumed can be varied. In an refinement of this embodiment, the mounting structure is arranged pivotable around the cylinder axis of the epilation axis. The movable mounting structure can be arranged so as to snap into the first position and the second position.

In another embodiment, the manually operable adjustment mechanism comprises a displacement mechanism that is arranged to be switchable between at least a first displacement and a second displacement. The manually operable adjustment mechanism assumes the first adjustment when the displacement mechanism is in the first displacement and the second adjustment when the displacement mechanism is in the second displacement. The displacement mechanism displaces at least a part of the actuation system. Specifically, the displacement mechanism rotates the part of the actuation system around the cylinder axis of the epilation cylinder.

In a further embodiment, the razor blade is mounted in a cartridge. In an even further embodiment, the razor blade is floatingly or rotatably mounted so that the razor blade can adapt to uneven skin surfaces and stay in contact with the skin while the hybrid epilator device is drawn over the skin.

BRIEF DESCRIPTION OF THE DRAWINGS

The invention will be further described and elucidated by a description of exemplary embodiments of a hybrid epilator device as proposed and with reference to figures. In the figures

DETAILED DESCRIPTION OF THE INVENTION

Figure 1:
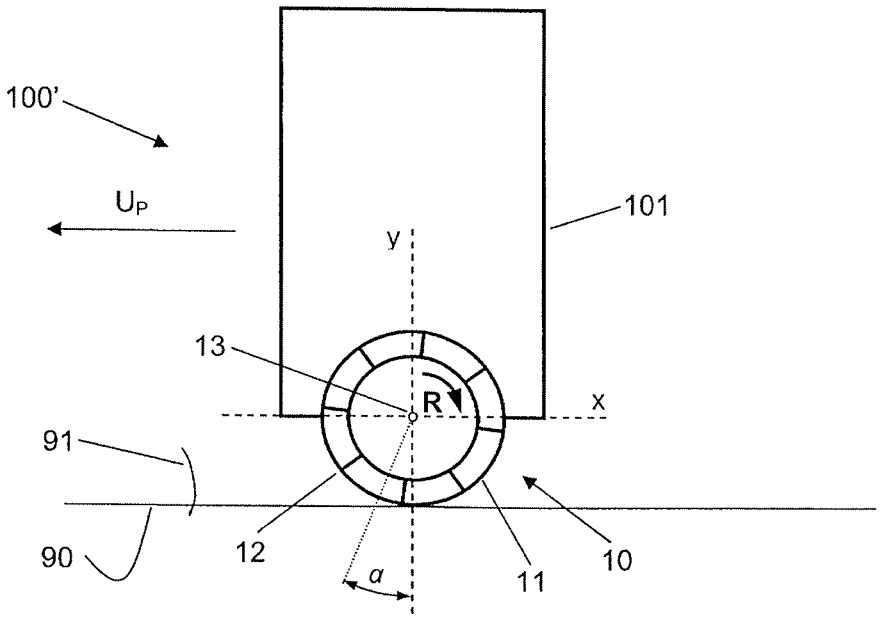
FIG. 1 shows a schematic depiction of an epilator device as proposed.

FIG. 1 is a schematic depiction of an epilator device 100' as generally known in the art. The epilator device 100' comprises a housing 101 at which an epilation unit 10 is mounted as is known in the art; e.g. international patent application WO 2006/037392 A1, the respective content of which is incorporated herein by reference, describes such a typical epilation unit 10 and its mounting arrangement. The epilation unit 10 is arranged for gripping and plucking out hairs 91 growing on a skin surface 90 during regular operation of the epilator device 100'. The epilation unit 10 comprises an epilation cylinder 11 that has axially and circumferentially spaced pairs of clamping elements 12 arranged on its cylinder surface. In operation, the epilation cylinder 11 rotates around its cylinder axis 13 in the direction R as indicated by an arrow. The epilator device 100' is drawn in the preferred use direction $U_P$ over the skin surface 90 to grip and pluck out hairs 91. An actuation system (details of the actuation system are discussed with reference to FIG. 5 below), as is e.g. also described in WO 2006/037392 A1 or in WO 2006/037391 A1 (the respective content being incorporated herein by reference), actuates during operation at least a movable clamping element of each pair of clamping elements 12 such that each pair of clamping elements 12 assumes an open position in which a gap is present between the clamping elements 12 such that hairs 91 could feed into the gap and a closed position in which the clamping elements 12 get into tight contact such that hairs 91 present in the gap are gripped and plucked out from the skin surface 90 while the epilation cylinder 11 continues to rotate. The clamping elements 12 assume the closed position at an angular position α with respect to a coordinate system (indicated by dashed lines x and y) fixed at the housing 101 and with origin in the cylinder axis 13. The angular position α at which the closed position is assumed is usually optimized for high epilation efficiency (the epilation efficiency being defined as the number of hairs being plucked out from a skin surface area in a single stroke vs. the number of hairs growing on the skin surface area before epilation treatment). Achieving optimal epilation efficiency requires that the epilator device 100' is placed on the skin surface 90 with a certain advised angle so that the clamping elements 12 also assume the closed position at the angular position α with respect to the skin surface 90 as the coordinate system is then considered to be fixed to a planar skin surface 90.

Figure 2:
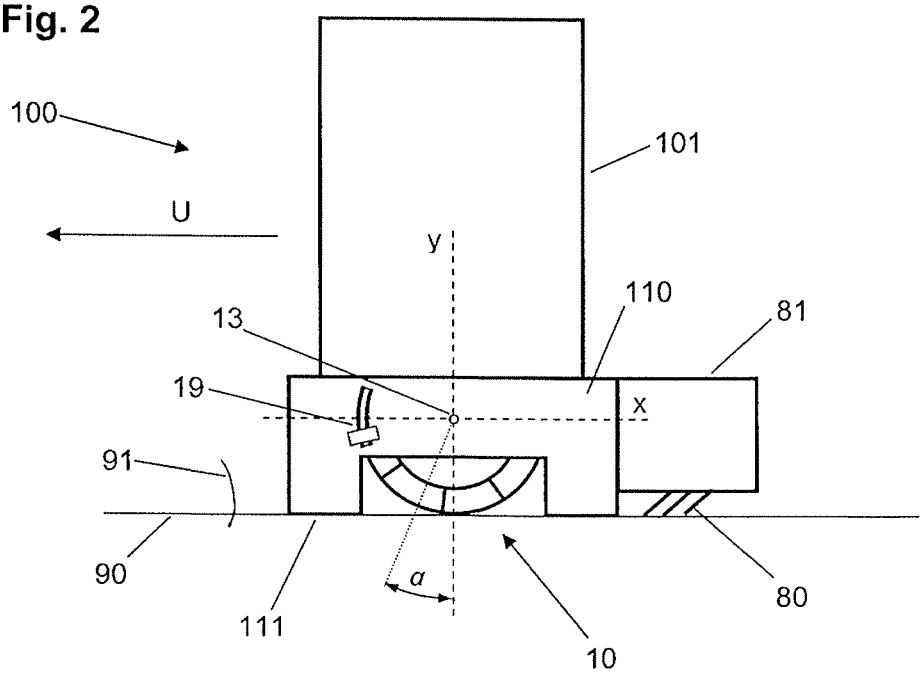
FIG. 2 shows a schematic depiction of an exemplary embodiment of a hybrid epilator device as proposed.

FIG. 2 is a schematic depiction of an exemplary embodiment of a hybrid epilator device 100 as proposed. The hybrid epilator device 100 comprises an epilation unit 10 as discussed with reference to FIG. 1 and further comprises at least a razor blade 80, where in the embodiment shown in FIG. 2 three razor blades 80 are mounted in a cartridge 81. The cartridge 81 may be realized as a standard razor blade cartridge as is generally known in the art of safety razors. The cartridge 81 is part of a mounting structure 110 that is mounted to the housing 101 of the hybrid epilator device 100. The mounting structure 110 may be arranged so that it can be pivoted around cylinder axis 13 of the epilation cylinder 11. The mounting structure 110 is shown in FIG. 2 in a first position and can be moved into a second position by manually pivoting it around the cylinder axis 13. The mounting structure 110 may snap into the first position and into the second position, e.g. by providing respective recesses in the housing 101 into which projections of the mounting structure 110 snap in. As will be explained with reference to FIG. 3A, the mounting structure 110 thus allows adjusting the angular position α at which the closed position of the pair of clamping elements 12 is assumed with respect to the skin surface 90. The cartridge 81 may be a fixedly mounted part of the mounting structure 110 or the cartridge 81 may be a pivotable and/or floatable part of the mounting structure 110 so that the razor blade 80 can adapt its contact to uneven skin surface topology. It is to be understood that in all embodiments of the hybrid epilator device 100, a single razor blade 80 can be present or two, three (as shown), four, or five etc. razor blades 80 could be present.

The razor blade 80 has a sharp edge for shaving off hairs 91 from the skin surface 90 when the hybrid epilator device 100 is drawn over the skin surface 90 along a use direction U. The razor blade 80 is mounted behind the epilation unit 10 with respect to the use direction U. The epilation unit 10 and the razor blade 80 are mounted for simultaneous contact of the skin surface 90 so that in operation the epilation unit 10 first grips and plucks out hairs 91 from the skin surface 90 and then the razor blade 80 shaves off remaining hairs 91 still growing on the skin surface 90 in the same stroke.

The hybrid epilator device 100 further comprises a displacement mechanism 19 for adjusting the angular position α at which the closed position is achieved. The displacement mechanism 19 can be switched from a first displacement position that is shown in FIG. 2 to a second displacement position, which is shown in and described with reference to FIG. 3B. If the epilation unit 10 would be realized as is e.g. described in WO 2006/037391 A1, the respective content of this document being incorporated herein by reference, the displacement mechanism could rotate a pressure plate (defining the closed position of the clamping elements) being part of an actuation system so that the angular position α would then also be rotated (this is discussed in more detail with respect to FIG. 5). In FIG. 2, the displacement mechanism 19 is locked in the first displacement position. The mounting structure 110 may have skin contact faces 111 that together with the razor blade 80 define the skin contact plane at which the hybrid epilator device 100 has to contact the skin surface 90 so that simultaneous plucking out and shaving off of hairs is effectuated.

An epilation unit 10 as known in the art may have an epilation efficiency of up to about 90%, which means that nine out of ten hairs 91 are gripped and plucked out from the skin surface 90 in a single stroke of the hybrid epilator device 100 (the epilation efficiency is hence the ratio of the number of plucked out hairs in a single stroke over a certain skin surface area and the number of hairs present on the skin surface area before epilation). It can now be assumed without prejudice that the razor blade 80 shaves off all remaining hairs 91 that were not plucked out by the epilation unit 10 in the same single stroke. Hence, the hybrid epilator device 100 has a hair removal efficiency of 100%. The ratio R between the number of plucked out hairs $N_P$ and the number of shaved off hairs $N_S$ is then $R=N_P/N_S=9$. In addition to the high hair removal efficiency in a single stroke, the hybrid epilator device 100, specifically when used in a wet environment, e.g. in combination with a shaving lotion, generates a gentle and smooth skin feeling that is not reached with a pure epilator device, as the razor blade 80 also abrades top skin parts. Such a hybrid epilator device 100 is hence specifically fast in achieving complete hair removal on a certain skin surface area (e.g. a leg) and it also reduces the pain involved with plucking out hairs as hairs not plucked out in the first stroke are shaved off.

Figure 3A:
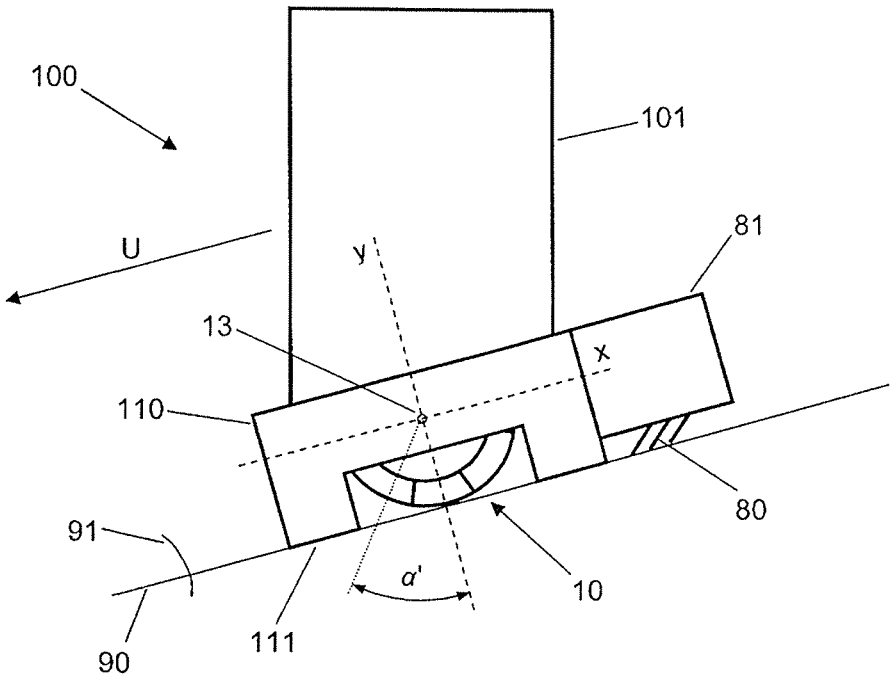
FIG. 3A shows a schematic depiction of the hybrid epilator device as depicted in FIG. 1 where the razor blade is in a second position.

FIG. 3A is a schematic depiction of the hybrid epilator device 100 as shown in FIG. 2, where the mounting structure 110 is moved into a second position by pivoting the mounting structure 110 around the cylinder axis 13. In this second position, the razor blade a 80 and the epilation unit 10 can still simultaneously contact the skin surface 90, but the angular position α' at which the closed position of the clamping elements is assumed is changed to a larger angle with respect to the skin surface 90 (or with respect to the coordinate system—indicated by dashed lines x and y—that is fixed to the mounting structure 110). The closed position is now assumed at an angular position α' at which the clamping elements 12 have moved farther away from the skin surface 90 in contrast to the angular position α as shown in FIG. 2. At the angular position α' shown in FIG. 3A, hairs 91 that have fed into the gap between the clamping elements 12 in the open position may have slipped out of the gap already before the closed position is assumed. Hence, in the second position of the razor blade 80 the epilation efficiency of the epilation unit 10 has dropped when compared to the efficiency of the epilation unit 10 when the razor blade 80 is in the first position (FIG. 2). Hence, the ratio R between the number of plucked out hairs $N_P$ and the number of shaved off hairs $N_S$ is reduced, e.g. the epilation unit 10 may have only an efficiency of 50% (i.e. five hairs of ten are plucked out in a single stroke) and the razor blades 80 then removes the remaining 50% of hairs growing on a certain skin surface so that R=1). The proposed hybrid epilator device 100 thus allows that the ratio R is modified by the user through a simple rotation of the mounting structure 110 from a first rotation position to a second rotation position (which also moves the razor blade 80 from a first position to a second position) and thus the plucking pain involved with complete hair removal is changed and can be adapted to the individual preferences.

Figure 3B:
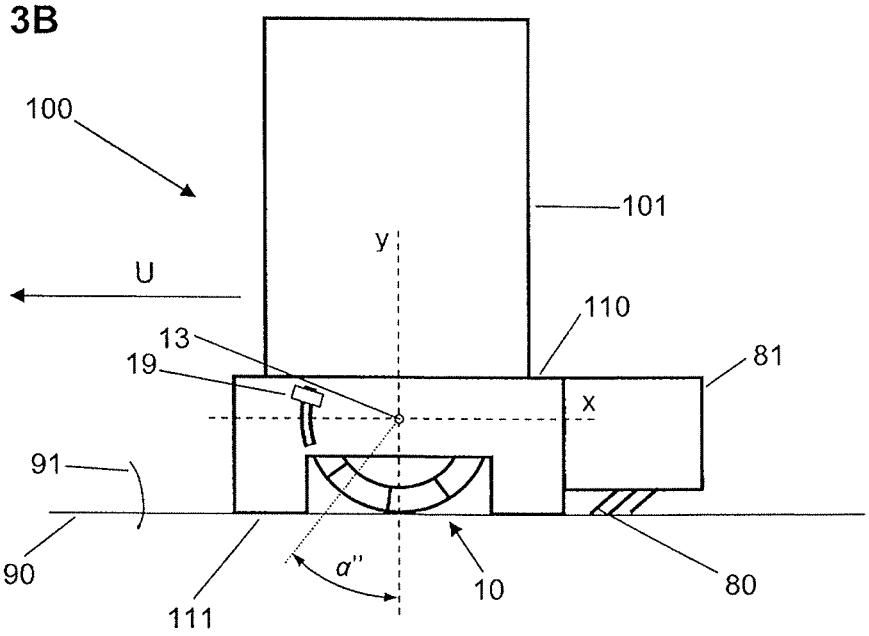
FIG. 3B shows a schematic depiction of the hybrid epilator device as depicted in FIG. 1 where the epilation cylinder is in a second adjustment.

FIG. 3B is a schematic depiction of the hybrid epilator device 100 shown in FIG. 2 but with the displacement mechanism 19 being locked into a second displacement. As explained previously, the displacement mechanism 19 as discussed here may comprise a lever that acts on pressure plates of an actuation system such that the pressure plates are rotated around the cylinder axis 13 when switching the displacement mechanism 19 from the first displacement to the second displacement. The angular position α" at which the closed position of the clamping elements 12 is assumed in the second displacement is shifted to a larger angle with respect to the skin surface 90 in operation. As discussed in conjunction with FIG. 3A, the shift of the angular position α" at which the closed position of the pair of clamping elements 12 is assumed leads to a lower epilation efficiency of the epilation unit 10 and hence to an adjustment of the ratio of the number of hairs that are plucked out from the skin surface vs. the number of (remaining) hairs that are shaved off.

In summary, two different approaches are presented to realize a manually operable adjustment mechanism that allows for adjusting the angular position at which the closed position of the pairs of clamping elements is assumed during regular operation with respect to the skin surface (i.e. the epilation efficiency of the epilation unit is made adjustable) between at least a first and a second adjustment. In the first embodiment, the manually operable adjustment mechanism comprises a mounting structure that can be moved between a first and a second position, where the first position relates to the first adjustment of the angular position and the second position relates to the second adjustment. In the second embodiment, the manually operable adjustment mechanism comprises a displacement mechanism that can be switched from a first displacement to a second displacement, where the first displacement relates to the first adjustment of the angular position and the second displacement relates to the second adjustment.

In another embodiment of a hybrid epilator device, the epilation unit 10 is arranged to be displaceable, i.e. a manually operable adjustment system (here: this may be realized as a simple lever that extends through the housing and which lever is coupled to the epilation unit 10) moves the epilation unit 10 such that a distance between the outer surface of the epilation unit 10 and a skin contact surface defined by the skin contact face 111 and the sharp edge of the razor blade 80 can be achieved. The farther away the epilation unit 10 is from the skin contact surface (and hence from the skin surface during regular operation), the lower the epilation efficiency becomes. The displacement adjustment is done manually, e.g. via a lever accessible at the outer surface of the housing 101 and the epilation unit 10 could be arranged to snap into a proximate position and a distal position.

Figure 4:
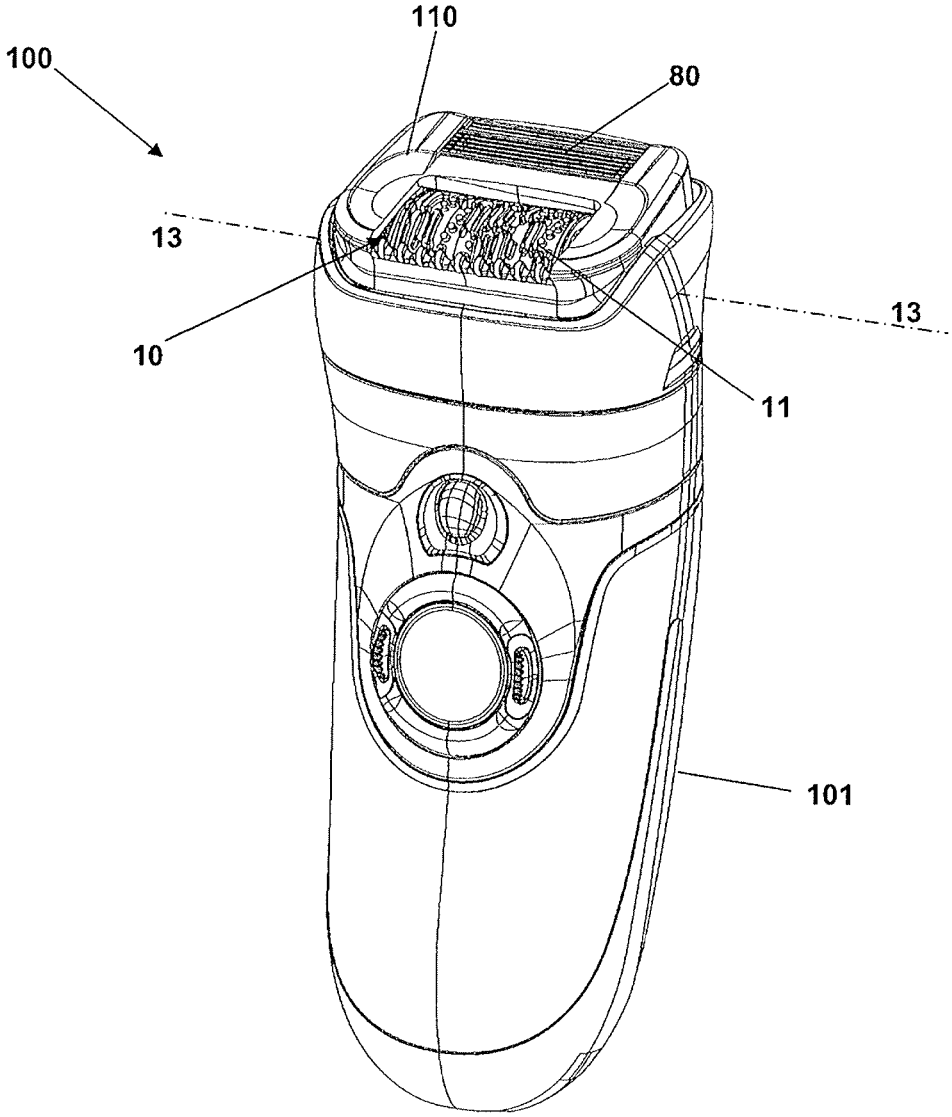
FIG. 4 shows a possible realization of a hybrid epilator device.

FIG. 4 is a depiction of a realization of an exemplary embodiment of a hybrid epilator device 100 as proposed. The hybrid epilator device 100 has a housing 101 and an epilation unit 10 mounted at a head region of the housing 101. A mounting structure 110 is mounted to the housing 101 so as to provide an aperture into which the epilation cylinder 11 of the epilation unit 10 extends and so as to be pivotable around the cylinder axis 13 (indicated by a dashed-dotted line) of the epilation cylinder 11. Several razor blades 80 are mounted directly at the mounting structure 110 and are provided for simultaneous contact with the skin surface together with the epilation cylinder 11.

Figure 5:
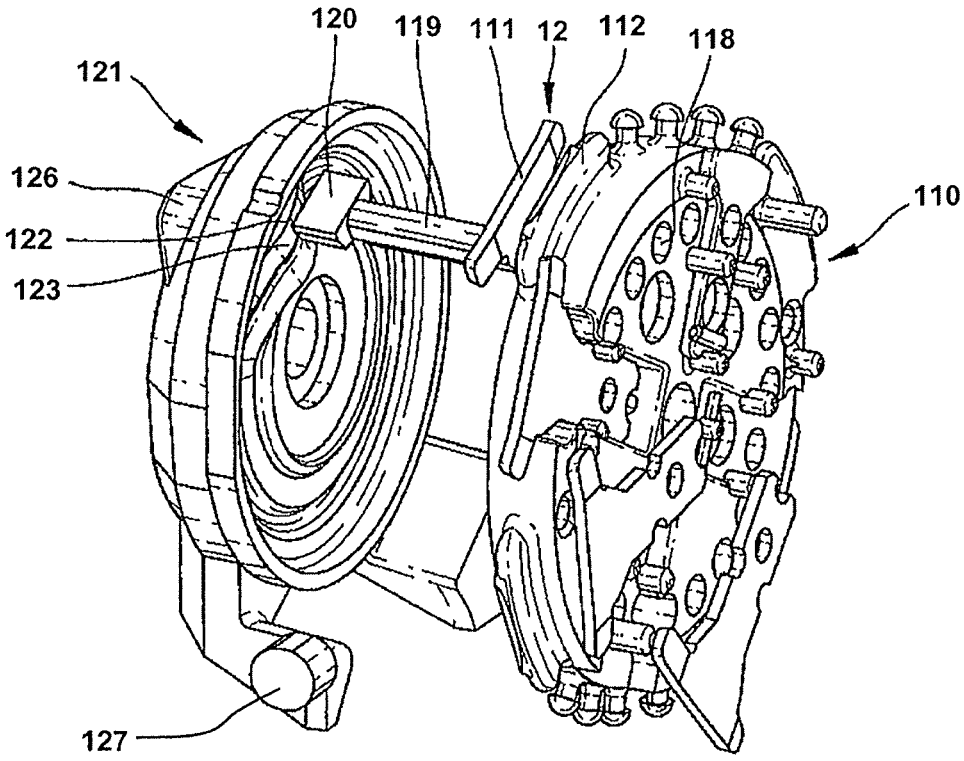
FIG. 5 shows components of an epilation cylinder and an actuation system of an epilation unit.

FIG. 5 shows components of an exemplary embodiment of an epilation cylinder and an actuation system, which exemplary embodiment is discussed in WO 2006/037391 A1, in the form of a perspective representation. Only one rod 119 for actuating a movable clamping element 111 of a pair of clamping elements 12 is respectively illustrated in FIG. 5 so as to provide a better overview. The actuation rods 119 extend through holes 118 that are provided in discs 110 that form the epilation cylinder. A holding arrangement 126 is provided for a bow spring that will press discs 110 and pressure plates 121 together (the epilation cylinder consists of several discs 110 and two pressure discs 121 are arranged at the ends of the epilation cylinder). In operation, the epilation cylinder comprising the discs 110 and the actuation rods 119 rotates, while the pressure plates 121 are fixed with respect to the housing of the hybrid epilator device. A pressure element 122 provided on the inner face of the pressure plate 121 is shaped such that a control surface 123 forms an elevation that, referred to the circumferential direction of the pressure plate 121, begins in the form of a steadily ascending ramp and ends in a steadily descending ramp. During operation, a head part 120 of the actuation rod 119 moves along the control surface 123 of the pressure plate 121 and the clamping element 111 coupled to the actuation rod 119 is pressed against a non-movable clamping element 112 so that the clamping elements 111 and 112 assume a closed position at a certain angular position that is defined by the relative position of the pressure plate 121 to the housing of the hybrid epilator device. The displacement mechanism 19 as discussed with reference to FIGS. 2 and 3B may act on a lever 127 and thus can rotate the pressure plate 121 (and its respective counterpart arranged at the opposite end of the epilation cylinder) when the displacement mechanism is switched from a first displacement to a second displacement.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. Hybrid epilator device comprising:

at least a razor blade having a sharp edge for cutting hairs;

an epilation cylinder comprising at least a pair of clamping elements that during operation are actuated by an actuation system between an open position and a closed position so that hairs can feed into the gap between the pair of clamping elements in the open position and are gripped and plucked out from the skin surface when the pair of clamping elements is in the closed position; and a manually operable adjustment mechanism that has a least a first adjustment and a second adjustment such that in the first adjustment and the second adjustment the skin surface can be simultaneously contacted by the sharp edge of the razor blade and a circumferential area of the epilation cylinder, while the angular position at which the closed position of the pair of clamping elements is assumed with respect to the skin surface during regular operation is different in the first and second adjustment;

wherein the manually operable adjustment mechanism comprises a mounting structure at which the razor blade is mounted, the mounting structure being movable at least between a first position and a second position, the first position relating to the first adjustment and the second position relating to the second adjustment; and wherein the mounting structure is pivotable around the cylinder axis of the epilation cylinder.

2. Hybrid epilator device according to claim 1, wherein the mounting structure is arranged to snap into each of the first position and the second position.

3. Hybrid epilator device according to claim 1, wherein the manually operable adjustment mechanism comprises a displacement mechanism being switchable between at least a first displacement and a second displacement, the first displacement relating to the first adjustment and the second displacement relating to the second adjustment, the displacement mechanism displacing at least a part of the actuation system.

4. Hybrid epilator device according to claim 3, wherein the displacement mechanism rotates the part of the actuation system around the cylinder axis of the epilation cylinder.

5. Hybrid epilator device according to claim 1, wherein the razor blade is mounted in a cartridge.

6. Hybrid epilator device according to claim 3, wherein the razor blade is mounted in a cartridge.

7. Hybrid epilator device according to claim 1, wherein the razor blade is floatingly and/or rotatably mounted.

8. Hybrid epilator device according to claim 3, wherein the razor blade is floatingly and/or rotatably mounted.

9. Hybrid epilator device according to claim 5, wherein the razor blade is floatingly and/or rotatably mounted.

* * * * *